United States Patent [19]

Kluttz

[11] 3,940,915

[45] Mar. 2, 1976

[54] SPINNING RING MOUNTING MEANS

[76] Inventor: Walter A. Kluttz, c/o Kluttz Machine and Foundry Co., 711 E. Franklin St., Gastonia, N.C. 28052

[22] Filed: Feb. 24, 1975

[21] Appl. No.: 552,538

Related U.S. Application Data

[63] Continuation-in-part of Ser. No. 509,441, Sept. 26, 1974, abandoned.

[52] U.S. Cl. ..... 57/122

[51] Int. Cl.[2] ..... D01H 7/64

[58] Field of Search ..... 57/119, 120, 121, 122, 57/123, 124

[56] References Cited

UNITED STATES PATENTS

| | | | |
|---|---|---|---|
| 163,550 | 5/1875 | Trowbridge | 57/122 |
| 164,536 | 6/1875 | Dutcher | 57/122 |
| 370,234 | 9/1887 | Booth | 57/122 |
| 821,641 | 5/1906 | Hayden, Jr. | 57/119 |
| 849,734 | 4/1907 | Hayden, Jr. | 57/122 |
| 990,360 | 4/1911 | Houghton | 57/122 |
| 1,165,012 | 12/1915 | Maloney | 57/122 |
| 2,067,135 | 1/1937 | Banfield, Jr. | 57/122 |

*Primary Examiner*—John Petrakes
*Attorney, Agent, or Firm*—Richards, Shefte & Pinckney

[57] ABSTRACT

An arrangement for mounting spinning rings is provided that employs a set of chuck elements at each ring rail spindle opening to grip a spinning ring thereat in a manner which allows replacement or a change in ring size much more readily than has heretofore been possible.

13 Claims, 13 Drawing Figures

SPINNING RING MOUNTING MEANS

CROSS-REFERENCES TO RELATED APPLICATIONS

This is a continuation-in-part of copending application Ser. No. 509,441, filed Sept. 26, 1974, and now abandoned in favor of this application.

BACKGROUND OF THE INVENTION

Spinning rings are normally mounted on the ring rail of a spinning frame through use of ring holders that are installed at the ring rail spindle openings and held in place by snap rings engaging the holders below the rail. As a consequence, the ring rail must be removed from the frame for either mounting or removing the rings, and when the ring size is to be changed a new rail suited to the particular changed size of ring must be provided. In addition, the considerable number of rings that must be handled in the case of a change over or whenever replacement is necessary imposes a tedious and expensive downtime burden on mill operations according to usual practice.

The prior art has recognized this problem, as in U.S. Pat. Nos. 164,536 and 990,360, but no satisfactory solution has heretofore been devised insofar as I am aware.

SUMMARY OF THE INVENTION

According to the present invention ring rail mounting of spinning rings is greatly simplified and expedited by providing a set of three chuck elements for mounting each ring. The chuck elements of the set are each arcuately grooved at one face for supported disposition in slidable relation within a ring rail spindle opening and are also arcuately grooved at their opposite face for gripping in slidable relation a spinning ring to be installed at the spindle opening. The set of chuck elements has an aggregate arcuate length when slid to adjacency within the spindle opening that does not exceed 180° so that the spinning ring may be released readily whenever desired, while being gripped and held in place by the chuck elements as long as they are maintained at opposing positions within the opening. In gripping position the chuck elements are spaced at intervals of about 120° within the spindle opening, and at least one of the chuck elements is preferably biased inwardly within the opening both to insure a centered spinning ring grip and to ease release thereof as noted in further detail below. The chuck elements may also be arranged for inverting to provide for mounting differently sized spinning rings in accordance with the modified embodiments described below.

DESCRIPTION OF THE PREFERRED EMBODIMENT

Figure 1:
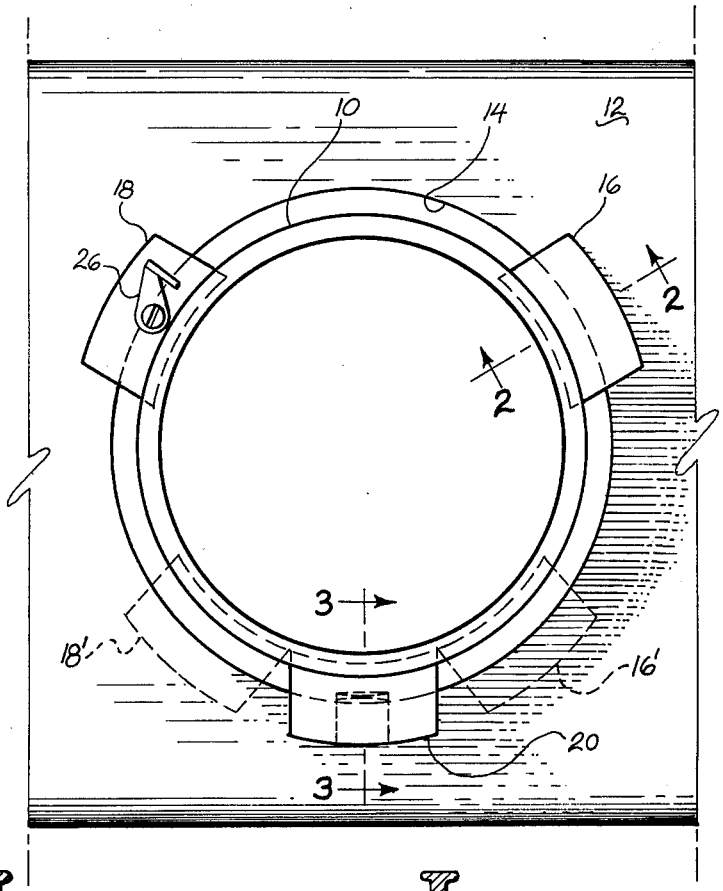
FIG. 1 is a plan view of a spinning ring mounted on a ring rail in accordance with the present invention.

In FIG. 1 of the drawings, a mounted spinning ring is designated by the reference numeral 10, a ring rail portion by the numeral 12, a ring rail spindle opening by the numeral 14, and a set of chuck elements embodying the present invention by the respective reference numerals 16, 18 and 20.

Figure 2:
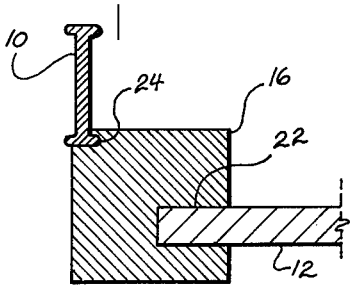
FIG. 2 is an enlarged sectional detail taken at the line 2—2 in FIG. 1.

All three of the chuck elements 16, 18 and 20 are basically similar and may have identical overall dimensions so that all may be formed from a common basic piece. FIG. 2 shows the chuck element 16, which is the simplest one, to be supported on ring rail 12 at a groove 22 formed arcuately (Compare FIGS. 1 and 2) in one face for slidable disposition on rail 12 within the spindle opening 14, and also to have an arcuate groove 24 formed at its opposite face for gripping the spinning ring 10 in slidable relation at an outer peripheral portion of its lower flange. The second chuck element 18 is a full counterpart of the element 16 just described except that it has a traveler clearing finger 26 attached thereto by a fastening screw as shown in FIG. 1, although this finger 26 might alternatively be mounted on chuck element 16 as a matter of choice.

Figure 3:
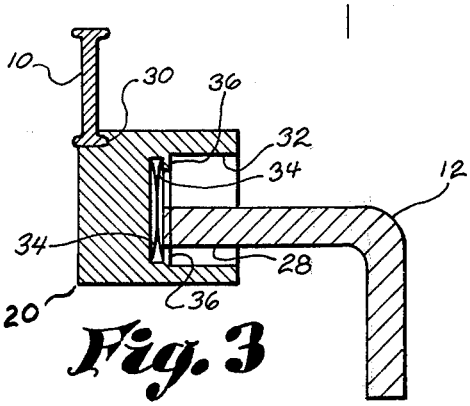
FIG. 3 is an enlarged sectional detail taken at the line 3—3 in FIG. 1.
Figure 4:
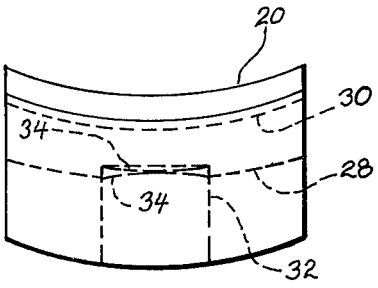
FIG. 4 is a plan view of the chuck element shown in FIG. 3.
Figure 5:
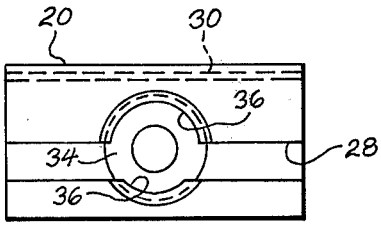
FIG. 5 is a side view as seen from the bottom in FIG. 4.
Figure 6:
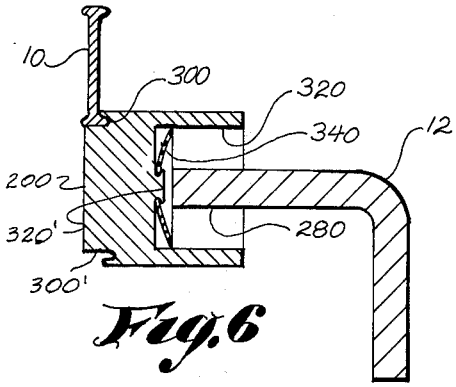
FIG. 6 is a sectional detail corresponding to FIG. 3 but showing a modified form of chuck element arranged for inverting to mount differently sized spinning rings.

The remaining chuck element 20 of the ring mounting set also has opposite faces thereof arcuately grooved at 28 and at 30 (see FIGS. 3, 4 and 5) for supported disposition within the spindle opening 14 of ring rail 12 and for gripping the spinning ring 10 as the others, but it is further arranged to incorporate the previously mentioned inward bias by which a releasable grip is maintained on spinning ring 10 according to the preferred embodiment that is illustrated.

In order to provide this bias, chuck element 20 is bored as at 30 from the face thereof at which the ring rail groove 28 is formed in intersecting relation with this groove and has at least one leaf spring 34, and preferably a pair of such springs, seated in the bore 32 so as to bear against the adjacent edge portion of spindle opening 14 when element 20 is disposed on ring rail 12. The preferred form of leaf spring 34 is a circular annulus pressed to a spherical shape, and when a pair of these springs are used they are inverted with respect to each other for seating in bore 32. To hold the springs 34 in seated position, the bore 32 is specially counterbored to set up lip portions therein that may be swaged to spring confining position as indicated at 36.

As noted earlier, the chuck elements 16, 18 and 20 are spaced within the ring rail spindle opening 14 at intervals of approximately 120° for holding the spinning ring 10 in place. In this ring mounting arrangement, chuck elements 16 and 18 serve to locate spinning ring 10 in properly centered relation with respect to spindle opening 14, while the biased chuck element 20 acts to maintain an adequate grip on ring 10 and also to force any ring having an elliptic tendency into round as it is installed. In addition, all of the chuck elements 16, 18 and 20 further act in combination, through the arcuate grooving at which they respectively engage spinning ring 10 and ring rail 12, to plumb spinning ring 10 reliably at spindle opening 14 as an incident of installation.

The biased arrangement of chuck element 20 further serves to render an installed ring 10 easily releasable whenever desired by simply sliding the other chuck elements to adjacency so that they occupy an arcuate length that does not exceed 180° within spindle opening 14, as indicated in broken lines at 16' and 18' in FIG. 1. Initial outward pressure on the biased chuck element 20 can be employed to ease the spinning ring grip so that sliding of the other chuck elements is readily started, and for this reason chuck element 20 is preferably arranged at the accessible side of ring rail 12 where it can be reached conveniently for applying such pressure. Additionally, it is helpful to have chuck element 20 so arranged in order to have the other chuck elements within easy common reach when they have been slid to adjacency and need to be held in spindle opening 14 as the spinning ring 10 is released.

If the released spinning ring 10 is to be replaced, the replacement ring is simply seated in the arcuate grooving therefor in the respective chuck elements and the chuck elements 16 and 18 are returned to their 120° spacing to complete the replacement mounting with exceptional ease. If, on the other hand, a different size of spinning ring is to be substituted a new set of chuck elements is installed to fit the different ring size and the installation proceeds in the same way with the new chuck element set without any need to change the ring rail and at a very substantial reduction in the time and effort ordinarily needed for a ring size change.

The general advantages of the present invention can also be obtained without biasing any of the chuck elements and providing each of them instead with a tension screw by which they can be set within the spindle opening 14 at proper ring gripping positions after having been slid thereto, but such an arrangement imposes considerably more critical tolerances on the chuck element design and is a good deal more burdensome to manipulate, so that the preferred embodiment including a biased chuck element 20 as described above is preferred because of the greater facility with which it can be provided and used.

The modified form of chuck element 200 shown in FIGS. 6 through 9 of the drawings differs from those previously described in that it is arranged for inverting to mount differently sized spinning rings 10, and for service as a common basic unit for all members of the chuck element set.

For these purposes, each chuck element 200 has the arcuate grooving 280 that is provided for supported disposition on ring rail 12 arranged symmetrically in relation to its top and bottom faces, and has arcuate grooving 300 and 300' for gripping a spinning ring, as at 10, located adjacent both its top and bottom faces in respectively differing depths so that differently sized spinning rings are accommodated depending upon which face is disposed upwardly. In this manner each set of chuck elements 200 can be arranged for double duty and thereby further simplify a changeover between ring sizes when the change involves sizes that are reasonably close.

Also, it has been found that there is advantage in arranging all chuck elements of a set with an inward bias at their supported disposition on ring rail 12, and this is done in the case of chuck elements 200 by boring them at 320 from the element face that is arcuately grooved for supported disposition on ring rail 12 and in intersecting relation with such grooving 280, while leaving a central stub portion 320' projecting at the bottom of bore 320, and then seating an annular leaf spring 340 in bore 320 about the stub portion 320' which is staked to hold the spring 340 in place. By providing each chuck element 200 with a bias in this way it becomes possible to use all chuck elements interchangeably, and the biasing action is better distributed when a ring is gripped.

Figure 8:
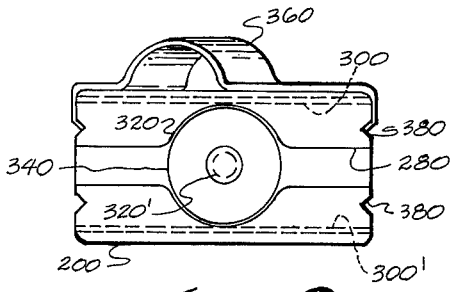
FIG. 8 is a right side elevation of the FIG. 6 chuck element with invertable clearing means disposed thereon.
Figure 7:
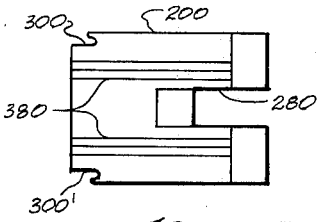
FIG. 7 is an end view of the FIG. 6 chuck element.
Figure 9:
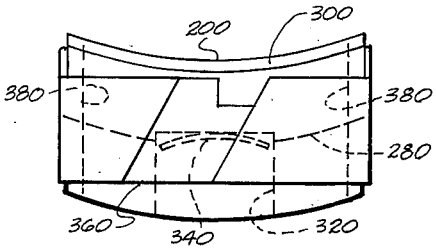
FIG. 9 is a top plan view corresponding to FIG. 8.
Figure 11:
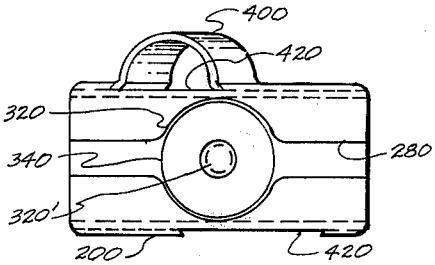
FIG. 11 is a right side elevation of a further modified form of invertable chuck member having a differently formed clearing means disposed thereon.
Figure 10:
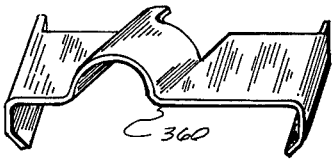
FIG. 10 is a perspective view of the clearing means shown in FIGS. 8 and 9.
Figure 12:
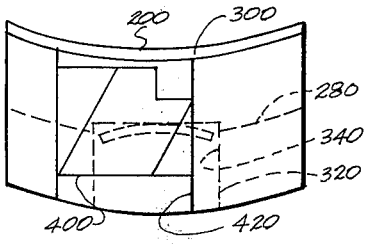
FIG. 12 is a top plan view corresponding to FIG. 11.
Figure 13:
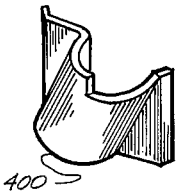
FIG. 13 is a perspective view of the clearing means shown in FIGS. 11 and 12.

Additionally, the invertable chuck elements 200 are arranged for disposition of clearing means 360 readily at whichever face is disposed upwardly. This is done by linearly grooving the chuck element end faces, as at 380, in spaced parallel relation to the top and bottom chuck element faces so that a clearing means 360 of the sort shown in FIG. 10 can be disposed in place as shown in FIGS. 8 and 9 and easily shifted to the opposite face whenever the chuck elements are inverted. Alternatively, a clearing means 400 having the form shown in FIG. 13 may be used by arranging the linear grooving, as indicated at 420 in FIGS. 11 and 12, in the top and bottom chuck element faces. Such arrangements allow the clearing means to be disposed on any chuck element of a set as well as to facilitate nicely any necessary repositioning of the clearing means whenever a changeover is made.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. Means for ring rail mounting of spinning rings comprising a set of three chuck elements, said elements each being arcuately grooved at one face for supported disposition in slidable relation within a ring rail spindle opening and also being arcuately grooved at the opposite face thereof for gripping in slidable relation a spinning ring to be installed at said ring rail spindle opening, and said elements having an aggregate arcuate length when slid to adjacency within said ring rail spindle opening that does not exceed 180°.

2. Means as defined in claim 1 in which said chuck elements are spaced at intervals of about 120° within said ring rail spindle opening for gripping said spinning ring.

3. Means as defined in claim 1 in which said chuck elements are arcuately grooved at said opposite face for gripping said spinning ring at an outer peripheral portion of a flange thereof.

4. Means as defined in claim 1 in which one of said chuck elements is biased inwardly within said ring rail spindle opening for securely gripping said spinning ring when the other elements of said set are slid to opposing positions within said opening.

5. Means as defined in claim 4 in which said biased chuck element is bored from the face thereof that is arcuately grooved for supported disposition on said ring rail in intersecting relation with said groove, and has at least one leaf spring seated in said bore for providing said bias.

6. Means as defined in claim 4 in which one of said chuck elements other than the biased one has a traveler clearing finger mounted thereon.

7. Means as defined in claim 4 in which said chuck elements are spaced at intervals of about 120° within said ring rail spindle opening for gripping said spinning ring, in which the chuck elements other than the one that is biased serve to center the gripped spinning ring with respect to said spindle opening, in which the biased chuck element acts to maintain an adequate grip on the spinning ring and hold it in round, and in which all of said chuck elements further act in combination to plumb the spinning ring reliably at said spindle opening.

8. Means as defined in claim 1 in which all of said chuck elements are biased inwardly within said ring rail spindle opening for securely gripping said spinning ring when said elements are slid to opposing position within said opening.

9. Means as defined in claim 8 in which the bias for said chuck elements is provided by an annular leaf spring seated in each element at the bottom of a bore extending from the element face that is arcuately grooved for supported disposition on said ring rail and intersecting such grooving.

10. Means as defined in claim 1 in which said chuck elements are arcuately grooved at said opposite face for gripping said spinning ring at an outer peripheral portion of a flange thereof, and said arcuate grooving is located adjacent both the top and bottom faces of said elements in respectively differing depths, whereby said elements may be inverted for gripping differently sized spinning rings.

11. Means as defined in claim 10 in which said chuck elements are additionally grooved for invertable disposition of clearing means at either the top or bottom face thereof.

12. Means as defined in claim 11 in which the end faces of said chuck elements are linearly grooved in spaced parallel relation to the top and bottom faces thereof for holding said invertable clearing means in relation to either of said top and bottom faces.

13. Means as defined in claim 11 in which the top and bottom faces of said chuck elements are linearly grooved for holding said invertable clearing means in relation to either of said faces.

* * * * *